US010431199B2

(12) United States Patent
Yang et al.

(10) Patent No.: US 10,431,199 B2
(45) Date of Patent: Oct. 1, 2019

(54) ELECTRONIC DEVICE AND CONTROL METHOD OF EARPHONE DEVICE

(71) Applicant: Fortemedia, Inc., Santa Clara, CA (US)

(72) Inventors: Tsung-Lung Yang, Hsinchu (TW); Hung-Chih Teng, Taipei (TW)

(73) Assignee: FORTEMEDIA, INC., Santa Clara, CA (US)

( * ) Notice: Subject to any disclaimer, the term of this patent is extended or adjusted under 35 U.S.C. 154(b) by 0 days.

(21) Appl. No.: 15/952,448

(22) Filed: Apr. 13, 2018

(65) Prior Publication Data

US 2019/0066652 A1 Feb. 28, 2019

(30) Foreign Application Priority Data

Aug. 30, 2017 (CN) ..... 2017 1 0761549

(51) Int. Cl.
*G10K 11/178* (2006.01)
*H04R 1/10* (2006.01)

(52) U.S. Cl.
CPC .... *G10K 11/17823* (2018.01); *G10K 11/1783* (2018.01); *G10K 11/17881* (2018.01); *H04R 1/1041* (2013.01); *G10K 2210/1081* (2013.01); *G10K 2210/3025* (2013.01); *G10K 2210/3033* (2013.01); *G10K 2210/3044* (2013.01);
(Continued)

(58) Field of Classification Search
CPC ..... H04R 1/1041; H04R 2460/13; H04R 1/1008; H04R 3/04; H04R 1/1083; H04R 1/1091; H04R 2499/11; H04R 29/00; H04R 2430/01; H04R 3/005; H04R 1/22; H04R 2225/55; H04R 2227/003; H04R 25/505; H04R 25/554; G10K 11/178; G10K 11/175; G10K 11/17817; G10K 11/1783; G10K 11/17881; G10K 2210/1081; G10K 2210/12; G10K 2210/3035; G10K 2210/30351; G10K 2210/3036;
(Continued)

(56) References Cited

U.S. PATENT DOCUMENTS 5,787,399 A * 7/1998 Lee ..... G11C 7/16 704/201
6,741,707 B2 * 5/2004 Ray ..... G10K 11/178 381/71.11
(Continued)

*Primary Examiner* — Lun-See Lao
(74) *Attorney, Agent, or Firm* — McClure, Qualey & Rodack, LLP

(57) ABSTRACT

An electronic device including an earphone device is provided. The earphone device includes a shell, a speaker, a first microphone device, a memory circuit and a controller. The memory circuit stores multiple parameter sets. The first microphone device receives a first sound. The first microphone device generates first data based on the first sound. The controller compares the first data with the parameter sets of the memory circuit and determines which one of the parameter sets corresponds to the first data based on the frequency parameters and the volume parameters. The controller generates second data based on the adjustment parameters of the one of the parameter sets, and the speaker generates a second sound based on the second data. The first sound generates a third sound in the shell, and the phase of the second sound is substantially opposite to the phase of the third sound.

10 Claims, 8 Drawing Sheets

(52) U.S. Cl.
CPC ..... *G10K 2210/3046* (2013.01); *G10K 2210/30351* (2013.01); *H04R 1/1008* (2013.01); *H04R 1/1083* (2013.01); *H04R 2420/07* (2013.01); *H04R 2420/09* (2013.01); *H04R 2430/01* (2013.01)

(58) Field of Classification Search
CPC ..... G10K 2210/3045; H04B 1/385; H04B 2001/3866; H04B 5/0006
USPC ..... 381/74, 71.1–71.8, 71.11–71.14, 56–58, 381/94.1–94.4
See application file for complete search history.

(56) References Cited

U.S. PATENT DOCUMENTS

| | | | | |
|---|---|---|---|---|
| 8,693,700 | B2 * | 4/2014 | Bakalos | G10K 11/178 381/58 |
| 2009/0080667 | A1 * | 3/2009 | Wollmershauser | G10K 11/178 381/57 |
| 2010/0061564 | A1 * | 3/2010 | Clemow | G10K 11/178 381/71.6 |
| 2015/0063598 | A1 * | 3/2015 | Shah | G08B 3/10 381/105 |
| 2016/0249126 | A1 * | 8/2016 | Konjeti | H04R 1/1041 |
| 2016/0255448 | A1 * | 9/2016 | Morant | H04R 25/30 381/314 |
| 2017/0192923 | A1 * | 7/2017 | Liu | G06F 13/385 |
| 2018/0069815 | A1 * | 3/2018 | Fontana | H04L 51/04 |

* cited by examiner

ELECTRONIC DEVICE AND CONTROL METHOD OF EARPHONE DEVICE

CROSS REFERENCE TO RELATED APPLICATIONS

This Application claims priority of China Patent Application No. 201710761549.6, filed on Aug. 30, 2017, the entirety of which is incorporated by reference herein.

BACKGROUND OF THE INVENTION

Field of the Invention

The invention relates to an electronic device, and more particularly to an electronic device equipped with a noise-reduction earphone device.

Description of the Related Art

The earphone device allows users to listen to the audio of their choice in any environment. However, the noise in different environments may affect the audio output by the earphone, thereby affecting the performance of the earphone device and the experience of listening to the audio that it plays.

If the earphone has the function of reducing noise, the earphone device can be more widely applied in different environments, and the number of fields in which the earphone device can be applied can also be increased by reducing the influence of external environment noise on the audio selected by the listener. Therefore, there is a need for an earphone device having a noise reduction function to improve the effect of ambient noise on the earphone device, and to further improve the performance of the earphone device.

BRIEF SUMMARY OF THE INVENTION

An electronic device and a method for controlling an earphone device are provided. An exemplary embodiment of an electronic device comprises an earphone device. The earphone device comprises a shell, a speaker, a memory circuit and a controller. The speaker is disposed inside of the shell. The first microphone device is coupled to the shell. The memory circuit is configured to store a plurality of parameter sets. Each parameter set comprises one or more frequency parameters, one or more volume parameters and one or more adjustment parameters. The controller is coupled to the speaker, the first microphone device and the memory circuit. The first microphone device is configured to receive a first sound outside of the shell. The first microphone device is further configured to generate first data based on the first sound and transmit the first data to the controller. The controller is configured to compare the first data with the parameter sets and determine which one of the parameter sets corresponds to the first data based on the frequency parameters and the volume parameters in the one of the parameter sets. The controller is further configured to generate second data based on the adjustment parameters in the one of the parameter sets, and the speaker is configured to generate a second sound based on the second data. The first sound generates a third sound in the shell, and a phase of the second sound is substantially opposite to a phase of the third sound.

An exemplary embodiment of a method for controlling an earphone device comprises: receiving a first sound outside of a shell of the earphone device via a first microphone device of the earphone device; generating first data based on the first sound and transmit the first data to a controller of the earphone device using the first microphone device; comparing the first data with a plurality of parameter sets and determining which one of the parameter sets corresponds to the first data based on frequency parameters and volume parameters of the one of the parameter sets via the controller; generating second data based on adjustment parameters of the one of the parameter sets via the controller; and generating a second sound based on the second data via a speaker of the earphone device. The first sound generates a third sound in the shell, and a phase of the second sound is substantially opposite to a phase of the third sound.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
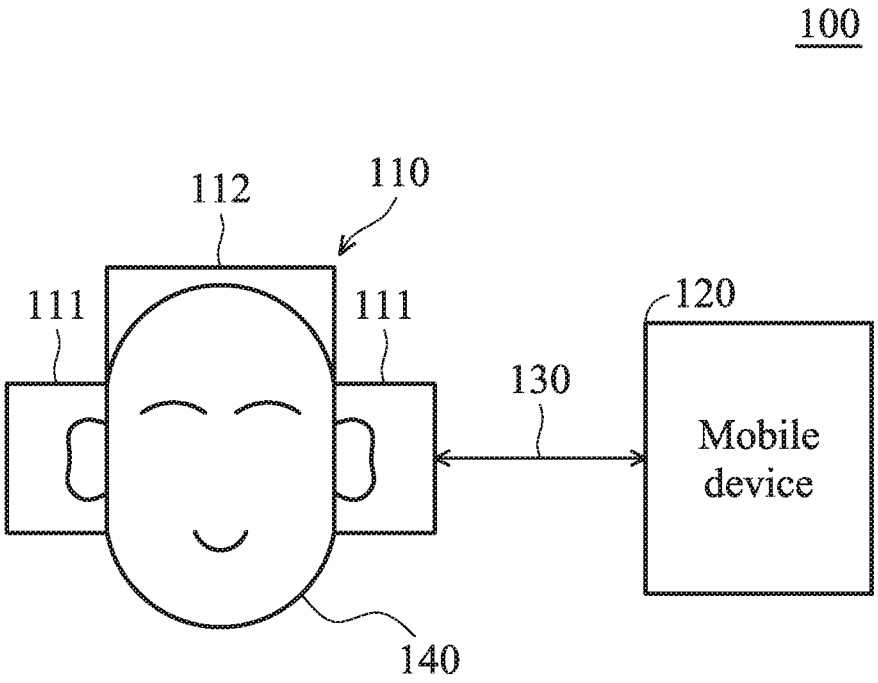
FIG. 1 is a schematic diagram of an electronic device according to an embodiment of the invention.

FIG. 1 is a schematic diagram of an electronic device according to an embodiment of the invention. The electronic device 100 may comprise an earphone device 110 and a mobile device 120. The earphone device 110 may comprise a shell 111 and a bracket 112, and the inner spaces of the shell 111 may correspond to the ears of the user 140. On the other hand, the earphone device 110 may communicate with the mobile device 120 via an interface 130. In some embodiments, the interface 130 may be a wireless communication interface or a wired communication interface.

In some embodiments, the interface 130 may be the transmission interface in compliance with the USB type-C standard. In this case, the mobile device 120 may be configured to provide power to the earphone device 110 via the interface 130. Therefore, the earphone device 110 may be not equipped with a battery, and the size of the earphone device 110 may be reduced.

Figure 2:
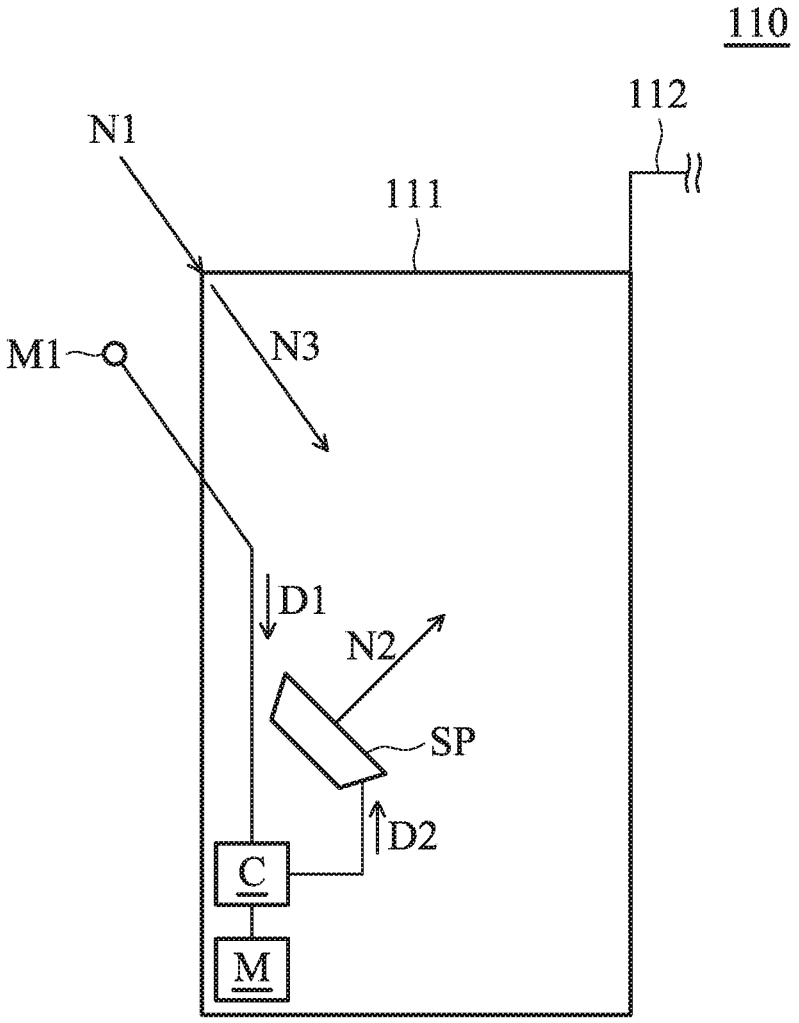
FIG. 2 is a schematic diagram of an earphone device according to an embodiment of the invention.

FIG. 2 is a schematic diagram of an earphone device 110 according to an embodiment of the invention. For simplicity and clarity, FIG. 2 only shows a portion of the components of the earphone device 110. As shown in FIG. 2, the earphone device 110 may comprise a shell 111, a bracket 112, a speaker SP, a microphone device M1, a controller C and a memory circuit M. The speaker SP may be configured inside of the shell 111. The microphone device M1 is coupled to the shell 111. The controller C is coupled to the speaker SP, the microphone device M1 and the memory circuit M.

In some embodiments, the controller C may perform digital signal processing (DSP) functions. In some embodiments, the microphone device M1 may comprise analog/digital conversion circuits. In some embodiments, the memory circuit M is configured to store a plurality of parameter sets (such as lookup tables), and each parameter set comprises one or more frequency parameters, one or more volume parameters and one or more adjustment parameters. For example, one of the parameter sets may comprise the frequency parameters, the volume parameters and the adjustment parameters corresponding to a specific frequency response.

In some embodiments, the frequency parameters and the volume parameters in each parameter set may correspond to the frequency response of the ambient noise in a specific field or a specific situation. For example, the frequency response of the ambient noise in different environments such as an airplane, the MRT (mass rapid transit), the subway, the high speed rail, the train station, the office, a restaurant, or others. In addition, each parameter set may comprise one or more adjustment parameters corresponding to the specific frequency response. In some embodiments, ambient noise may refer to noise signals under 1 KHz.

As shown in FIG. 2, the sound N1 propagates outside of the shell 111 of the earphone device (in some embodiments, the sound N1 may be ambient noise), and the sound N1 may become the sound N3 when the sound N1 is transmitted to the inside of the shell 111. When the microphone device M1 receives the sound N1, the microphone device M1 generates data D1 based on the sound N1, and transmits the data D1 to the controller C. The controller C compares the data D1 to the parameter sets in the memory circuit M. For example, the controller C may compare the frequency parameters and the volume parameters (such as the distribution of the corresponding volume of each frequency component) of the data D1 with the frequency parameters and the volume parameters in the parameter sets. In this embodiment, the controller C may determine that the frequency parameters and the volume parameters of the data D1 are most similar to the frequency parameters and the volume parameters of the n-th parameter set among the plurality of parameter sets (for example, the frequency parameter of the data D1 are most similar to that of the n-th parameter set, the volume parameter of the data D1 are most similar to that of the n-th parameter set, or the overall frequency parameter difference and the overall volume parameter difference between the data D1 and the n-th parameter set are smallest among the parameter sets). In this manner, the controller C may determine that the data D1 corresponds to the n-th parameter set among the plurality of parameter sets.

Then, the controller C may generate the data D2 based on at least the adjustment parameters of the n-th parameter set, and the speaker SP may generate the sound N2 based on the data D2. In this embodiment, a phase of the sound N2 generated by the speaker SP based on the data D2 is substantially opposite to a phase of the sound N3. In this case, when the sound N2 and the sound N3 are mixed, the volume of the sound N3 is reduced (or even eliminated), and thereby the earphone device 110 has a function of reducing noise.

For example, the memory circuit M of the earphone device 110 may store a plurality of parameter sets. Each parameter set may comprise different frequency parameters and volume parameters (for example, the frequency parameters and the volume parameters corresponding to the frequency response and the loudness of the ambient noise under a specific environment such as an airplane, the MRT, the subway, the high speed rail, the train station, the office, a restaurant, or others) and different adjustment parameters. When the user of the earphone device 110 is in the train station, the microphone device M1 of the earphone device 110 may generate data (for example, the data D1) after receiving the ambient noise (for example, the sound N1). The controller C may determine that the ambient noise is most similar to the parameter set corresponding to the train station noise (for example, the frequency parameters are most similar, the volume parameters are most similar, or the overall frequency parameter difference and the overall volume parameter difference are the smallest among the parameter sets). In this case, the controller C may select the parameter set corresponding to the train station noise stored in the memory circuit M based on the ambient noise, and the controller C may generate the data (for example, the data D2) based on the adjustment parameters in the parameter set corresponding to the train station noise, thereby generating a sound signal (for example, sound N2) having a phase that is opposite to that of the ambient noise (such as sound N3) generated inside of the shell 111 of the earphone device, and the function of noise reduction is performed.

In the above-described embodiments, the earphone device 110 may classify the ambient noise (such as sound N1) based on a plurality of pre-designed parameter sets. Therefore, after the microphone device M1 receives the ambient noise, the earphone device 110 may determine one parameter set (for example, the parameter set corresponding to the ambient noise on an airplane, the MRT, the subway, the high speed rail, the train station, the office, a restaurant, or others) which is most similar to the ambient noise, and then rapidly generate the data (for example, data D2) and the sound (for example, sound N2) based on the adjustment parameters in the parameter set corresponding to the ambient noise, so as to perform noise reduction. Therefore, via the device and the method using the plurality of parameter sets, the complexity of the circuit performing the noise reduction function in the earphone device 110 can be reduced, and the speed at which the earphone device 110 can perform noise reduction can be increased. The noise reduction performance of the earphone device 110 can thereby be improved.

In some embodiments, when the controller C determines that the volume of the sound N1 is lower than a predetermined volume based on the data D1, the controller C may determine not to compare the data D1 with the parameter sets. In this case, when the volume of the ambient noise is lower than the predetermined volume (for example, when the ambient noise is very low), the controller C does not perform the noise reduction function to generate the sound N2 as discussed above, thereby improving the power utilization efficiency of the earphone device 110.

Figure 3:
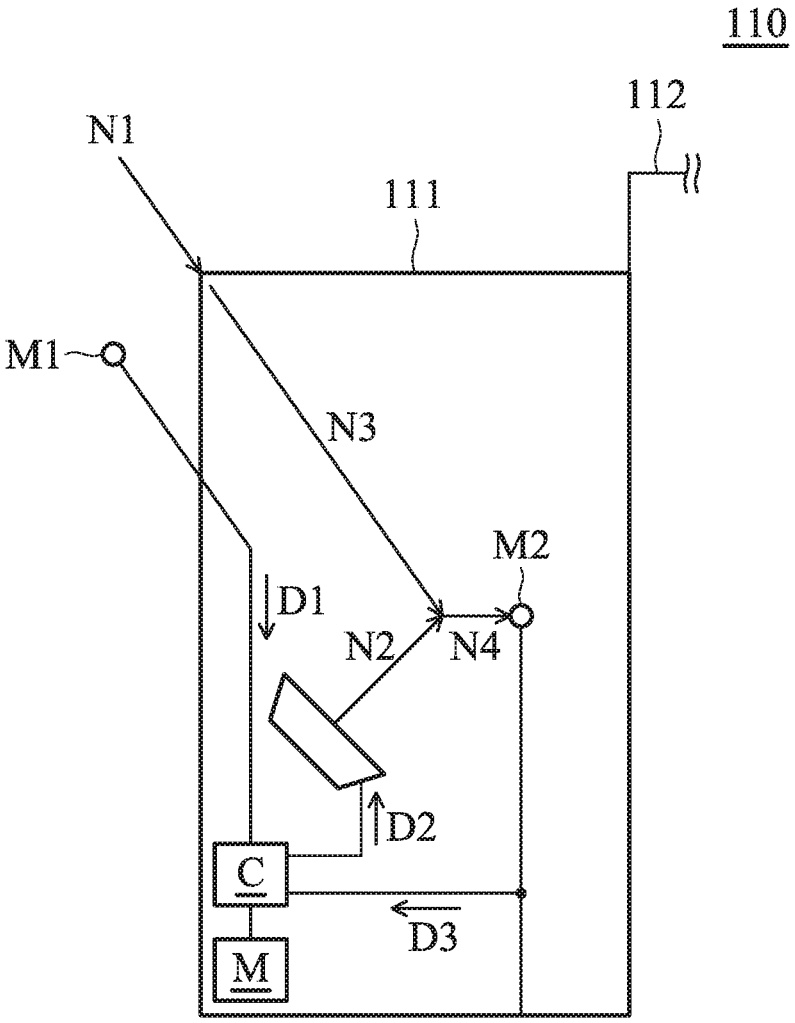
FIG. 3 is a schematic diagram of an earphone device according to another embodiment of the invention.

FIG. 3 is a schematic diagram of an earphone device according to another embodiment of the invention. For simplicity and clarity, FIG. 3 only shows a portion of the components of the earphone device 110. Compared to the embodiment shown in FIG. 2, the earphone device 110 shown in FIG. 3 may further comprise the microphone device M2 disposed inside of the shell 111 of the earphone device. In some embodiments, the microphone device M2 may comprise an analog/digital conversion circuits.

Referring to the embodiment of FIG. 2, the earphone device 110 may generate the sound N2 to reduce the volume of the sound N3, so as to achieve the noise reduction function. In the embodiment shown in FIG. 3, the microphone device M2 is configured to receive the sound N4 which is a mixture of the sound N2 and the sound N3. The microphone device M2 generates the data D3 based on the sound N4, and transmits the data D3 to the controller C.

Referring to the embodiment of FIG. 2, the controller C may determine that the data D1 corresponds to the n-th parameter set in the memory circuit M. Then, the controller C generates the data D2 based on the adjustment parameters of the n-th parameter set and the data D3, and the speaker SP generates the sound N2 based on the data D2, making the earphone device 110 have the noise reduction function.

In some embodiments, the microphone device M2 may detect the noise reduction performance inside the shell 111. For example, if the microphone device M2 receives the sound N4, and the controller C determines that the volume of the sound N3 is different from that of the sound N2 based on the data D3, the controller C may further adjust the data D2 based on the data D3 after the data D2 is generated based on the n-th parameter set, so as to make the volume of the sound N2 generated based on the adjusted dada D2 be closer to the volume of the sound N3 (that is, reducing the volume of the sound N4), so as to improve the noise reduction performance of the earphone device 110.

Figure 4:
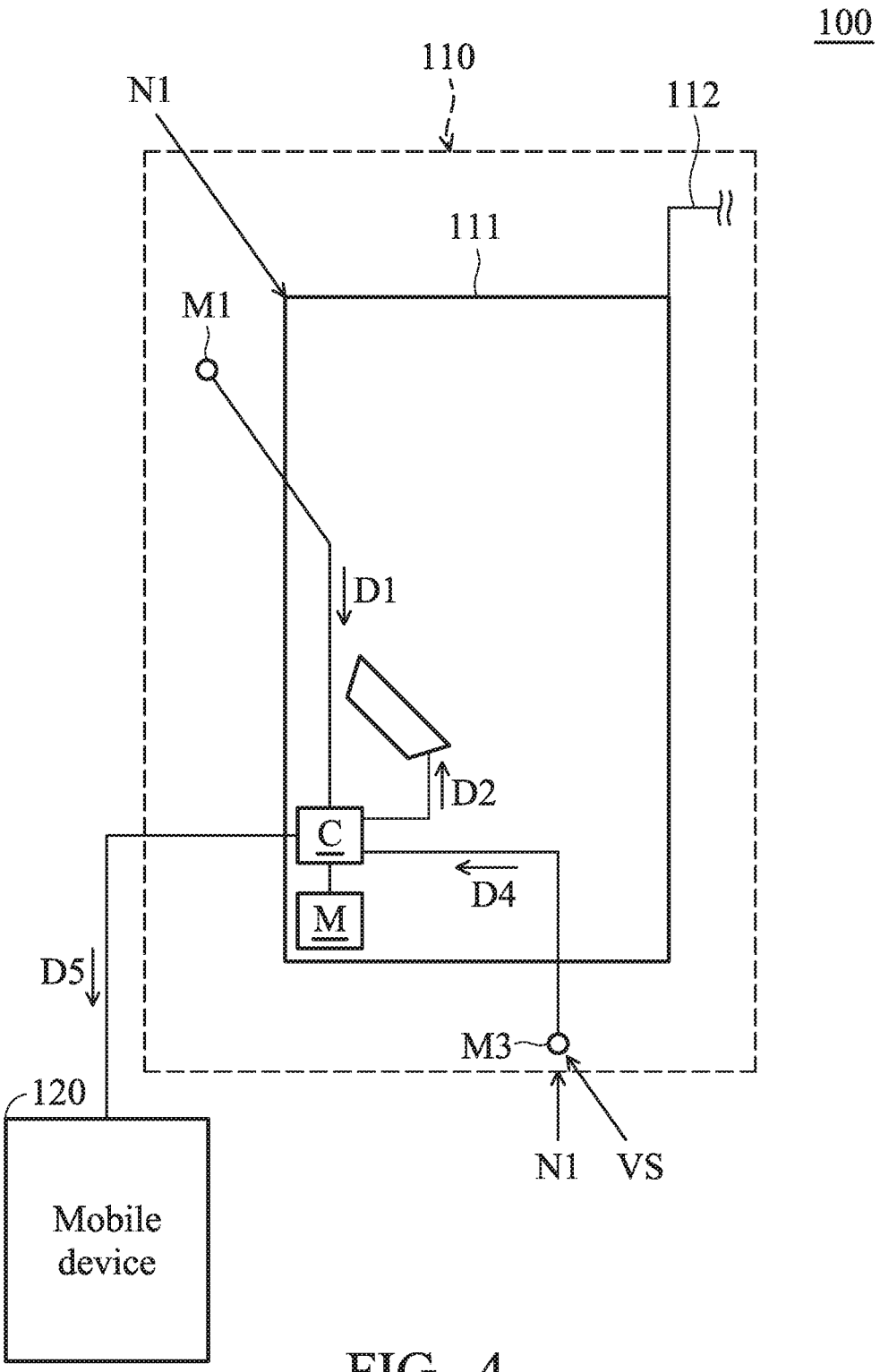
FIG. 4 is a schematic diagram of an electronic device according to another embodiment of the invention.

FIG. 4 is a schematic diagram of an electronic device according to another embodiment of the invention. For simplicity and clarity, FIG. 4 only shows a portion of the components of the earphone device 110 and the mobile device 120. Compared to the embodiment shown in FIG. 2, the earphone device 110 shown in FIG. 4 further comprises the microphone device M3. In this embodiment, the microphone device M3 is a talking microphone. In some embodiments, the microphone device M3 may comprise analog/digital conversion circuits.

Referring to the embodiment of FIG. 2 and FIG. 4, after receiving the voice of the user VS and the sound N1 (ambient noise), the microphone device M3 generates the data D4 based on the voice VS and the sound N1 and transmits the data D4 to the controller C. On the other hand, after the microphone device M1 receives the sound N1, the microphone device M1 generates the data D1 based on the sound N1, and transmits data D1 to the controller C. The controller C compares the data D1 with the parameter sets stored in the memory circuit M. In this embodiment, the controller C may determine that the data D1 is most similar to the n-th parameter set among the parameter sets stored in the memory circuit M. Therefore, the controller C may determine that the data D1 corresponds to the n-th parameter set in the plurality of parameter sets.

Then, the controller C may adjust the data D4 based on the adjustment parameters of the n-th parameter set, so as to reduce the volume of the sound N1 in the data D4. In this case, the controller C may adjust the data D4 based on the adjustment parameters of the n-th parameter set to generate the data D5 (that is, the adjusted data D4), and transmit the data D5 to the mobile device 120.

In this embodiment, the volume of the corresponding sound N1 in the data D5 is lower than the volume of the corresponding sound N1 in the data D4, so as to achieve the noise reduction function in the uplink signal (noise reduction for the voice communication).

Figure 5:
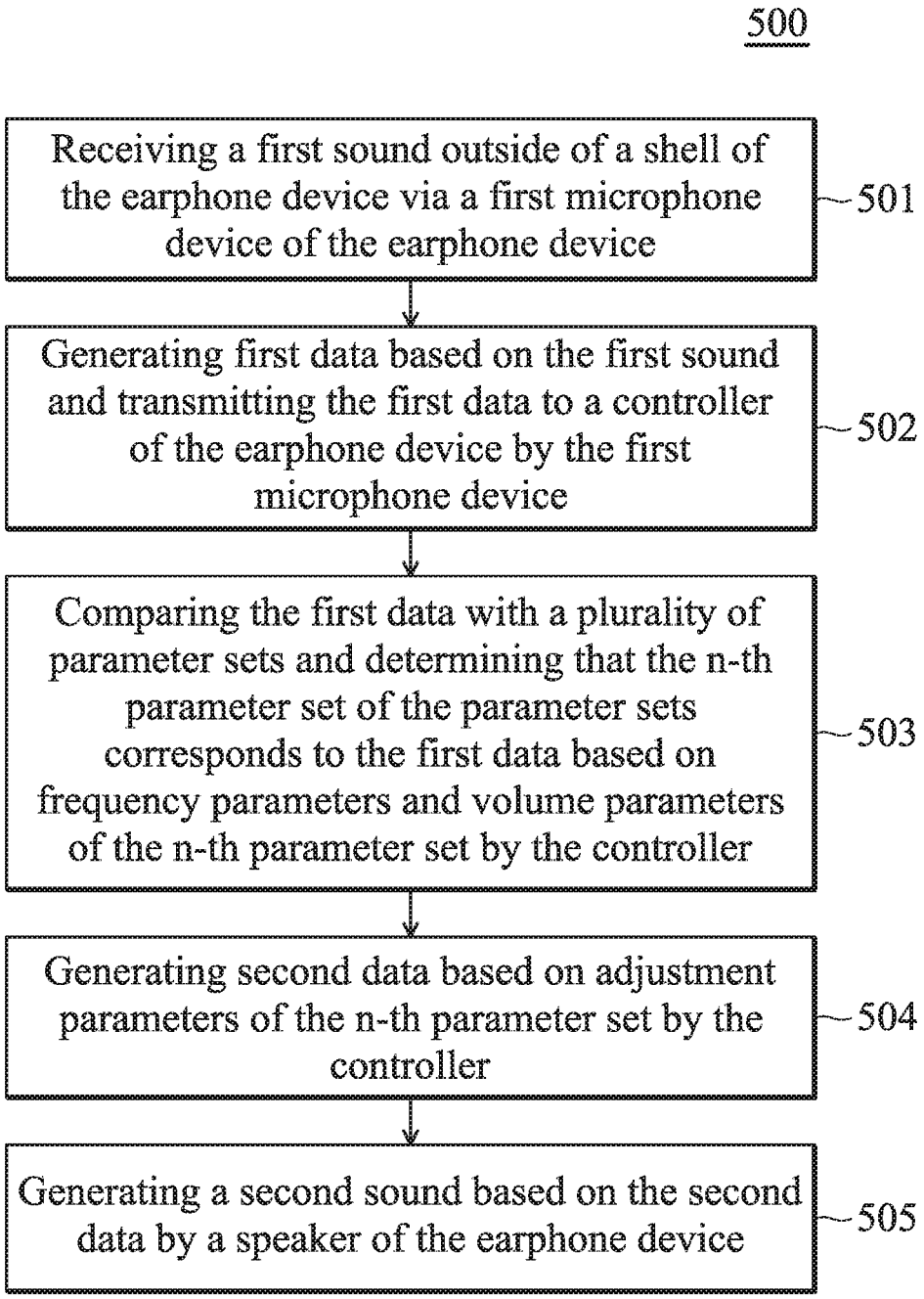
FIG. 5 is a flow chart of a method for controlling an earphone device according to an embodiment of the invention.

FIG. 5 is a flow chart of a method 500 for controlling an earphone device according to an embodiment of the invention. In step 501, the first microphone device of the earphone device receives a first sound outside of a shell of the earphone device. In step 502, the first microphone device generates first data based on the first sound and transmits the first data to a controller of the earphone device. In step S503, the controller compares the first data with a plurality of parameter sets and determines that the n-th (n is an integer) parameter set of the parameter sets corresponds to the first data based on frequency parameters and volume parameters of the n-th parameter set. In step S504, the controller generates second data based on adjustment parameters of the n-th parameter set. In step S505, the speaker of the earphone device generates a second sound based on the second data. In this embodiment, the first sound generates the third sound in the shell (that is, the first sound becomes the third sound when the first sound is transmitted to the inside of the shell 111), and the phase of the second sound is substantially opposite to the phase of the third sound.

Figure 6:
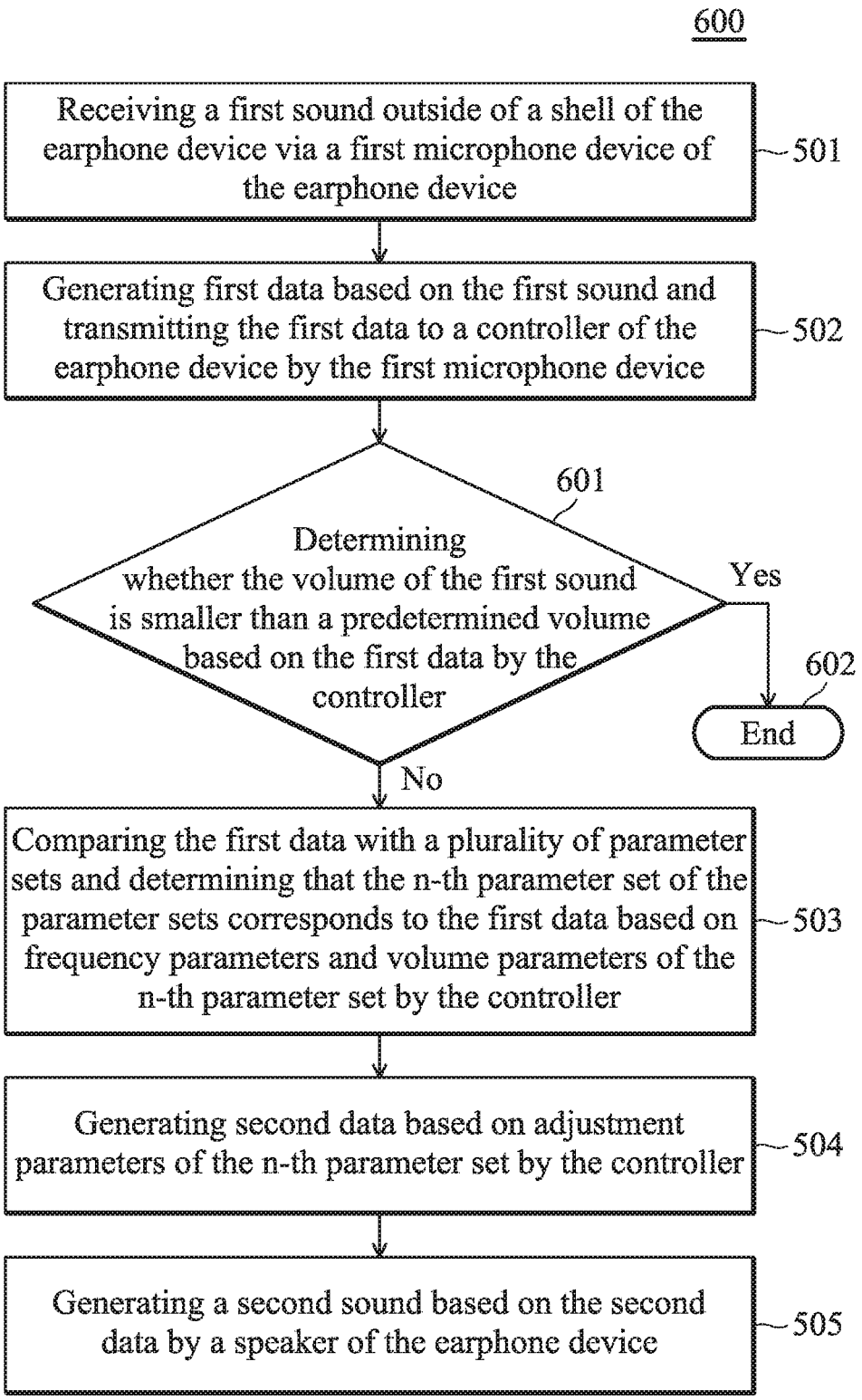
FIG. 6 is a flow chart of a method for controlling an earphone device according to an embodiment of the invention.

FIG. 6 is a flow chart of a method 600 for controlling an earphone device according to an embodiment of the invention. Compared to the method 500 shown in FIG. 5, in the method 600, the step 601 is performed after the step 502 is performed. In step 601, the controller determines whether the volume of the first sound is lower than a predetermined volume based on the first data. If not, the flow goes to the step 503. If so, the method 600 ends in step 602. Steps 501-505 in method 600 are the same as those in method 500, and the descriptions are omitted for brevity.

Figure 7:
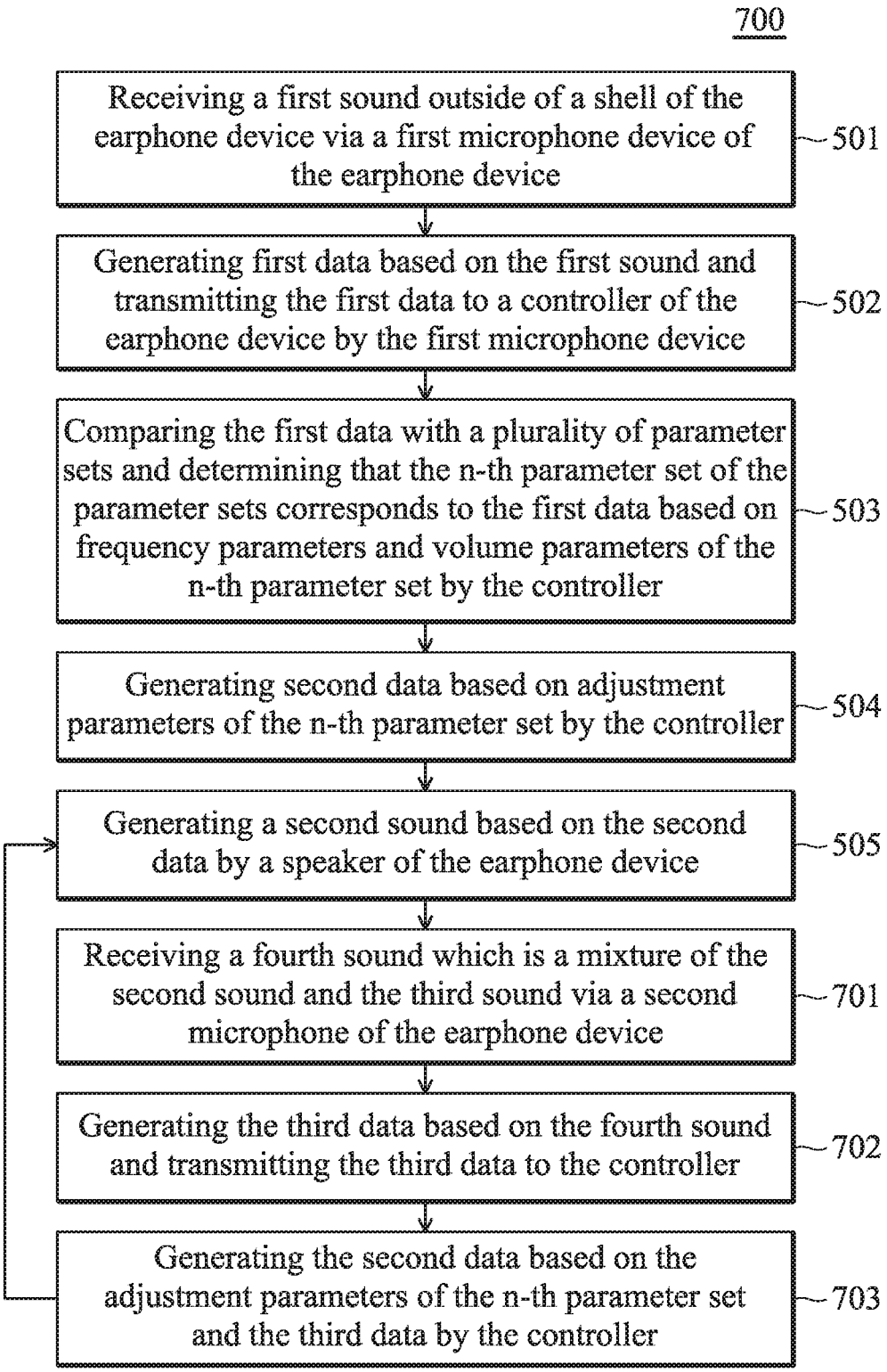
FIG. 7 is a flow chart of a method for controlling an earphone device according to an embodiment of the invention.

FIG. 7 is a flow chart of a method 700 for controlling an earphone device according to an embodiment of the invention. Compared to the method 500 shown in FIG. 5, the method 700 further comprises steps 701-703. In step 701, the second microphone device receives a fourth sound which is a mixture of the second sound and the third sound. In step 702, the second microphone device generates the third data based on the fourth sound and transmits the third data to the controller. In step 703, the controller generates the second data based on the adjustment parameters of the n-th parameter set and the third data. Steps 501-505 in method 700 are the same as those in method 500, and the descriptions are omitted for brevity.

In some embodiment, the step 703 may further comprise: adjusting the second data based on the third data by the controller when the controller determines, based on the third data, that the volume of the third sound is different from the volume of the second sound, so as to reduce the difference between the volume of the third sound and the volume of the second sound.

Figure 8:
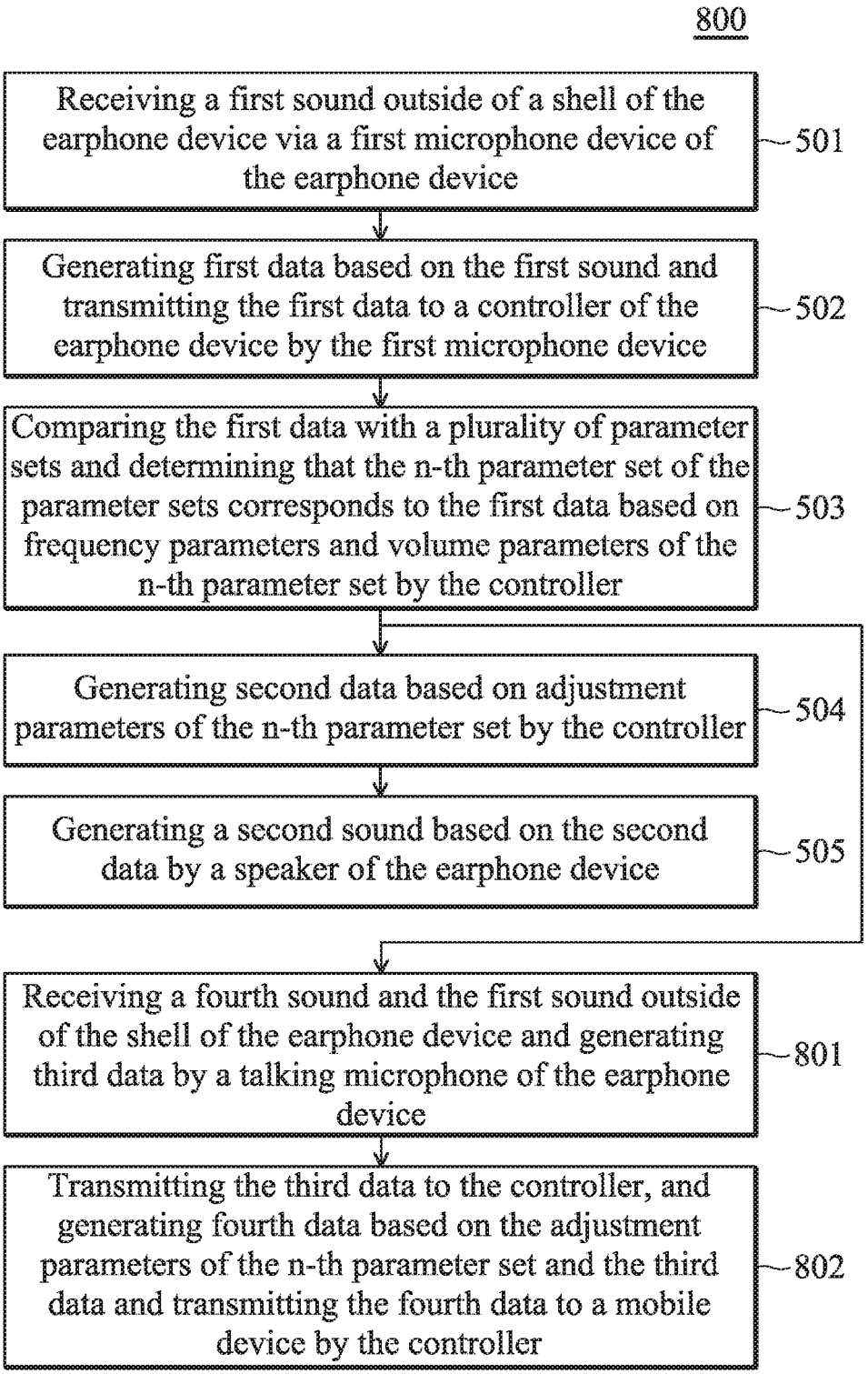
FIG. 8 is a flow chart of a method for controlling an earphone device according to an embodiment of the invention.

FIG. 8 is a flow chart of a method 800 for controlling an earphone device according to an embodiment of the invention. Compared to the method 500 shown in FIG. 5, the method 800 further comprises steps 801 and 802. In step 801, a talking microphone of the earphone device receives a fourth sound and the first sound outside of the shell of the earphone device and venerates third data. In step 802, the third data is transmitted to the controller, and the controller generates fourth data based on the adjustment parameters of the n-th parameter set and the third data and transmits the fourth data to a mobile device, Steps 501-505 in method 800 are the same as those in method 500, and the descriptions are omitted for brevity.

While the invention has been described by way of example and in terms of preferred embodiment, it should be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. An electronic device, comprising:

an earphone device, comprising:

a shell;

a speaker, disposed inside of the shell;

a first microphone device, coupled to the shell;

a memory circuit, configured to store a plurality of parameter sets, wherein each parameter set comprises a plurality of frequency parameters, a plurality of volume parameters and one or more adjustment parameters; and a controller, coupled to the speaker, the first microphone device and the memory circuit, wherein the first microphone device is configured to receive a first sound outside of the shell, wherein the first microphone device is further configured to generate first data based on the first sound and transmit the first data to the controller, wherein the controller is configured to compare the first data with the parameter sets by comparing frequency parameters and volume parameters of the first data with the frequency parameters and the volume parameters in the parameter sets and determine which one of the parameter sets corresponds to the first data based on the frequency parameters and the volume parameters of the one of the parameter sets by determining the frequency parameters and the volume parameters of the first data are most similar to the frequency parameters and the volume parameters of which parameter set, wherein the controller is further configured to generate second data based on the adjustment parameters of the one of the parameter sets, and the speaker is configured to generate a second sound based on the second data, and wherein the first sound generates a third sound in the shell, and a phase of the second sound is substantially opposite to a phase of the third sound.

2. The electronic device as claimed in claim 1, further comprising:

a mobile device, coupled to the earphone device via a USB type-C interface, wherein the mobile device is configured to provide power to the earphone device via the USB type-C interface.

3. The electronic device as claimed in claim 2, wherein the controller is further configured to not compare the first data with the parameter sets when the controller determines, based on the first data, that a volume of the first sound is lower than a predetermined volume.

4. The electronic device as claimed in claim 1, wherein the earphone device further comprises:

a second microphone device, disposed inside of the shell and coupled to the controller;

wherein the second microphone device is configured to receive a fourth sound which is a mixture of the second sound and the third sound, wherein the second microphone device is further configured to generate third data based on the fourth sound and transmit the third data to the controller, and wherein the controller is further configured to generate the second data based on the adjustment parameters of the one of the parameter sets and the third data.

5. The electronic device as claimed in claim 1, further comprising:

a mobile device, coupled to the earphone device, wherein the earphone device further comprises:

a talking microphone device, coupled to the controller and configured to receive a fourth sound and the first sound outside of the shell of the earphone device and generate third data, wherein the talking microphone device is configured to transmit the third data to the controller, and wherein the controller is configured to generate fourth data based on the adjustment parameters of the one of the parameter sets and the third data, and transmit the fourth data to the mobile device.

6. A method for controlling an earphone device, comprising:

receiving a first sound outside of a shell of the earphone device via a first microphone device of the earphone device;

generating first data based on the first sound and transmitting the first data to a controller of the earphone device using the first microphone device;

comparing the first data with a plurality of parameter sets by comparing frequency parameters and volume parameters of the first data with the frequency parameters and the volume parameters in the parameter sets and determining that one of the parameter sets corresponds to the first data based on frequency parameters and volume parameters of the one of the parameter sets by determining the frequency parameters and the volume parameters of the first data are most similar to the frequency parameters and the volume parameters of which parameter set via the controller;

generating second data based on adjustment parameters of the one of the parameter sets via the controller; and generating a second sound based on the second data via a speaker of the earphone device, wherein the first sound generates a third sound in the shell, and a phase of the second sound is substantially opposite to a phase of the third sound.

7. The method as claimed in claim 6, further comprising:

when the controller determines, based on the first data, that a volume of the first sound is lower than a predetermined volume, the step of comparing the first data with the parameter sets is not performed by the controller.

8. The method as claimed in claim 6, further comprising:

receiving a fourth sound which is a mixture of the second sound and the third sound via a second microphone device of the earphone device;

generating third data based on the fourth sound and transmitting the third data to the controller using the second microphone device; and generating the second data based on the adjustment parameters of the one of the parameter sets and the third data using the controller.

9. The method as claimed in claim 8, further comprising:

adjusting the second data based on the third data using the controller when the controller determines, based on the third data, that a volume of the third sound is different from a volume of the second sound, so as to reduce difference between the volume of the third sound and the volume of the second sound.

10. The method as claimed in claim 6, further comprising:

receiving a fourth sound and the first sound outside of the shell of the earphone device and generating third data using a talking microphone of the earphone device;

transmitting the third data to the controller; and generating fourth data based on the adjustment parameters of the one of the parameter sets and the third data and transmitting the fourth data to a mobile device via the controller.

* * * * *